US005860468A

United States Patent [19]

Cook

[11] Patent Number: 5,860,468

[45] **Date of Patent: *Jan. 19, 1999**

[54] VACUUM DIE CASTING

[76] Inventor: Arnold J. Cook, 413 N. Pasadena Dr., Pittsburgh, Pa. 15215

[ * ] Notice: This patent issued on a continued prosecution application filed under 37 CFR 1.53(d), and is subject to the twenty year patent term provisions of 35 U.S.C. 154(a)(2).

[21] Appl. No.: 819,171

[22] Filed: Mar. 17, 1997

Related U.S. Application Data

[63] Continuation-in-part of Ser. No. 634,683, Apr. 18, 1996, abandoned, which is a continuation of Ser. No. 422,618, Apr. 13, 1995, abandoned, which is a continuation of Ser. No. 98,529, Jul. 28, 1993, abandoned.

[51] Int. Cl.[6] ..... B22D 27/15; B22D 17/10

[52] U.S. Cl. ..... 164/61; 164/113; 164/256; 164/258

[58] Field of Search ..... 164/61, 62, 65, 164/113, 97, 254, 256, 258, 312

[56] References Cited

U.S. PATENT DOCUMENTS

| | | | |
|---|---|---|---|
| 3,019,495 | 2/1962 | Cornell | 164/62 |
| 3,208,113 | 9/1965 | Bennett | 164/312 |
| 4,154,286 | 5/1979 | Glazunov et al. | 164/256 |
| 4,340,109 | 7/1982 | Roddy | 164/97 |
| 4,741,384 | 5/1988 | Healey | 164/258 |
| 5,183,096 | 2/1993 | Cook | 164/97 |

FOREIGN PATENT DOCUMENTS

| | | | |
|---|---|---|---|
| 59-45071 | 3/1984 | Japan | 164/113 |
| 59-226139 | 12/1984 | Japan | 164/97 |
| 60-99471 | 6/1985 | Japan | 164/312 |
| 64-27756 | 1/1989 | Japan | 164/113 |
| 2-205242 | 8/1990 | Japan | 164/312 |
| 720613 | 12/1954 | United Kingdom | 164/65 |

*Primary Examiner*—Kuang Y. Lin
*Attorney, Agent, or Firm*—Ansel M. Schwartz

[57] ABSTRACT

A system for die casting including a die having a die cavity. There is also a vacuum chamber and a device for creating a vacuum in the vacuum chamber. The die casting system further includes an injection device for introducing a fluidically based material, such as molten metal, into the die cavity from the vacuum chamber. The injection device is in fluidic communication with the die cavity and is at least partially disposed within the vacuum chamber. The die casting system also includes a device for providing the fluidically based material into the injection device. The providing device is separated from the injection device and is preferably disposed within the vacuum chamber. A method of die casting includes the step of providing, such as by pouring, fluidically based material into an injection device within the vacuum chamber. Then, there is the step of forcing the fluidically based material into the die cavity with the injection device.

20 Claims, 6 Drawing Sheets

12
14
12
26
30
32
22
A
28
26
34
38
28
16

VACUUM DIE CASTING

This is a continuation-in-part application of U.S. patent application Ser. No. 08/634,683 filed on Apr. 18, 1996, abandoned, which is a continuation application of U.S. patent application Ser. No. 08/422,618 filed Apr. 13, 1995, abandoned, which is a continuation of U.S. patent application Ser. No. 08/098,529 filed Jul. 28, 1993, abandoned.

FIELD OF THE INVENTION

The present invention is related in general to casting. More specifically, the present invention is related to an apparatus and method for die casting wherein a die cavity is evacuated through an injection device and molten material is poured into the injection device within a vacuum chamber.

BACKGROUND OF THE INVENTION

It is known in the past to inject a melted material, such as metal, into a die cavity with an injection device having a shot sleeve and a ram. In some instances, a vacuum is pulled from the edge of the die cavity which pulls the melted material into the shot sleeve through a fill tube which is disposed within a crucible of melted material. As an example of this method, the reader should refer to Weingarten (U.S. Pat. No. 4,476,911) and Gibbs die casting literature.

It is also known to dispose a fill tube, which is in fluidic communication with the die cavity, in a crucible of melted material within a pressure vessel (see U.S. Pat. No. 4,573,517 to Booth et al.). The die cavity is evacuated through the fill tube in the melt inside a pressure vessel. The die cavity is filled with molten material by pressurizing the pressure vessel. These methods suffer because the fill tube must be heated and is constantly disposed within the melted material, it is prone to clogging, reaction, and breakage.

The present invention overcomes the problem of clogging by eliminating the fill tube and instead utilizes a device, isolated from the injection device, for providing the melted material into an injection device within a vacuum chamber.

SUMMARY OF THE INVENTION

The present invention pertains to a system for die casting. The die casting system is comprised of a die having a die cavity. There is also a vacuum chamber and a device for creating a vacuum in the vacuum chamber. The die casting system further comprises an injection device for introducing a fluidically based material, such as molten metal, into the die cavity from the vacuum chamber. The injection device is in fluidic communication with the die cavity and is at least partially disposed within the vacuum chamber. The die casting system also includes a device for providing the fluidically based material into the injection device. The providing device is preferably disposed within the vacuum chamber and preferably comprises a device for pouring the fluidically based material into the injection device. Preferably, the vacuum device is fluidically connected to the vacuum chamber so that the die cavity can be evacuated from the vacuum chamber through the injection device. Alternatively, the die cavity can be evacuated separately. Preferably, the injection device is comprised of a shot sleeve and a ram, which can be hydraulic or pneumatic, for instance. The ram can act as a valve to fluidically isolate the die cavity from the vacuum chamber.

In one embodiment, the pouring device is comprised of a tilt pour crucible system. The tilt pour crucible system comprises a crucible and a pivot element about which the crucible can tilt. The tilt pour crucible system also includes a mechanism for tilting the crucible about the pivot element such that the melted material pours into the injection device.

In another embodiment, the pouring device comprises a crucible having a pour hole disposed above the port of the shot sleeve and a lift plunger mechanism for selectively opening the pour hole such that when the pour hole is opened, the fluidically based material within the crucible, pours into the port of the shot sleeve.

In another embodiment, when the fluidically based material is a metal, such as titanium, having such a high melting point that it needs to be contained, the pouring device comprises a crucible having a pour hole and an arc melting system which creates a channel of molten metal within a solidified body of the metal. In this manner, the molten metal is isolated and cooled such that the interior of the vacuum chamber is not excessively heated.

In another embodiment, the pouring device can comprise means for pouring a first material into the injection device and means for pouring a second material into the injection device. For instance, the first material can be reinforcement material mixed with a binder, while the second material can be molten metal. Alternatively, the first material can be a powder.

The present invention is also a method of die casting. The method comprises the step of providing, such as by pouring, fluidically based material into the shot sleeve within the vacuum chamber. Then, there is the step of forcing the fluidically based material into the die cavity with a ram or gas.

The present invention can pull a much higher vacuum than the Weingarten system (U.S. Pat. No. 4,476,911), where the metal is not evacuated and metal entering will not lower the vacuum.

The present invention is the best method for casting higher temperature metals and infiltrating reinforcement in the mold.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
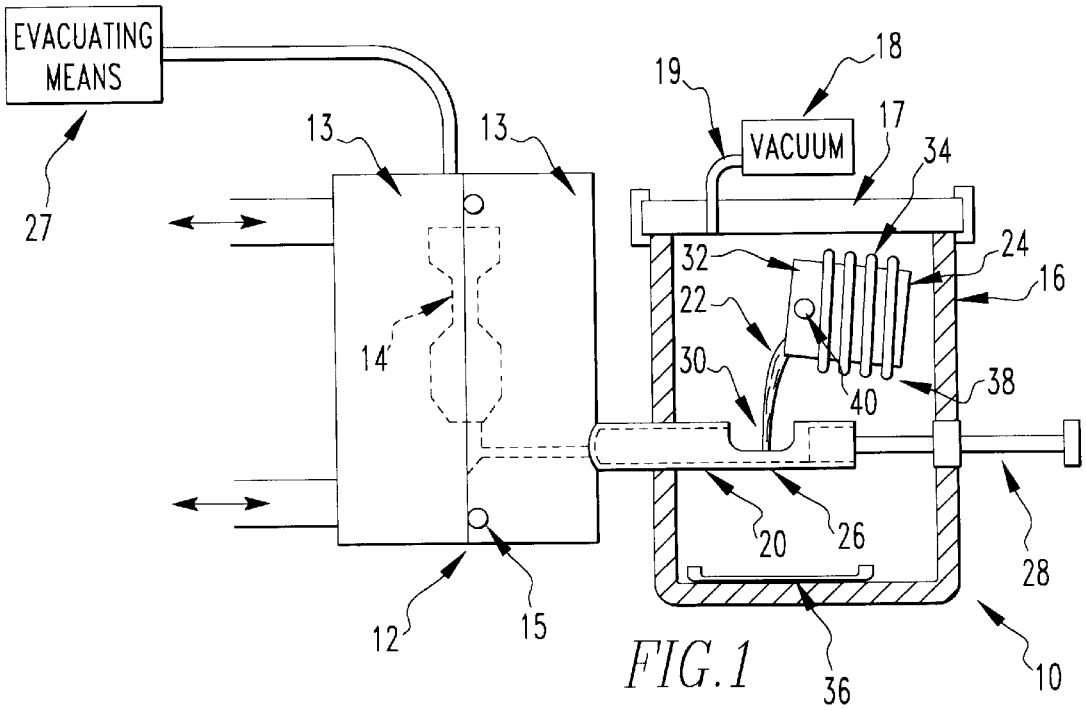
FIG. 1 is a schematic representation showing the die casting system.

Referring now to the drawings wherein like reference numerals refer to similar or identical parts throughout the several views, and more specifically to FIG. 1 thereof, there is shown a system 10 for die casting. The die casting system 10 is comprised of a die 12 having a die cavity 14. There is also a vacuum chamber 16 and a device 18 for creating a vacuum in the vacuum chamber 16. The die casting system 10 further comprises an injection device 20 for introducing a fluidically based material 22, such as molten metal, into the die cavity 14 from the vacuum chamber 16. The injection device 20 is in fluidic communication with the die cavity 14 and is at least partially disposed within the vacuum chamber 16. The die casting system 10 also includes a device for providing the fluidically based material 22 into the injection device 20. The providing device is isolated from the injection device. In other words, the providing device 19 and the injection device 20 are not in contact with each other.

Preferably, the providing device is disposed within the vacuum chamber 16, and preferably comprises a device 24 for pouring the fluidically based material 22 into the injection device 20. Preferably, the die 12 is comprised of mating die halves 13, which are sealed together with an o-ring 15, as is well known in the art of die casting. Preferably, the vacuum device 18 is fluidically connected to the vacuum chamber 16 so that the die cavity 14 can be evacuated from the vacuum chamber 16 through the injection device 20. Alternatively, the die cavity 14 can be evacuated with a separate evacuating means 27, such as through the parting line 39.

Figure 9:
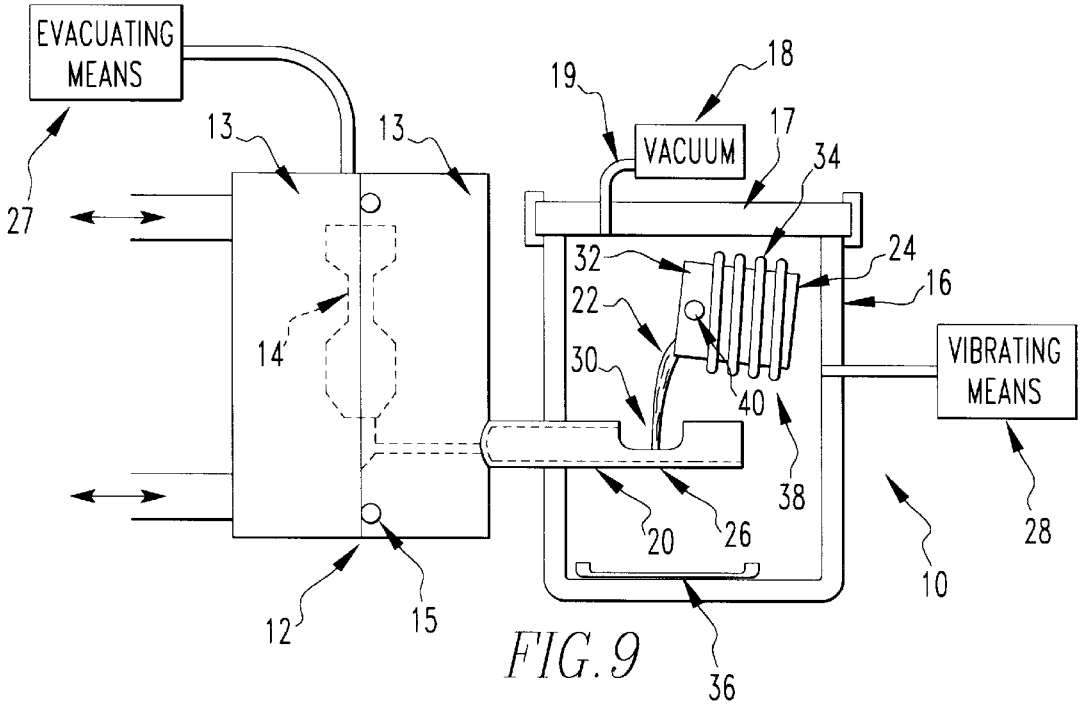
FIG. 9 is a schematic representation showing the die casting system with gas providing means attached to the vacuum chamber.

Preferably, the injection device 20 is comprised of a shot sleeve 26. The shot sleeve 26 preferably has a port 30 through which the fluidically based material 22 is poured into the shot sleeve 26 from the pouring device 24. As shown in FIG. 1, the material 22 can be forced into the die cavity 14 with a ram 28 which can be hydraulic or pneumatic, for instance. Alternatively, as shown in FIG. 9, the material 22 can be forced into the die cavity 14 with gas pressure from gas providing means 29.

Figure 10:
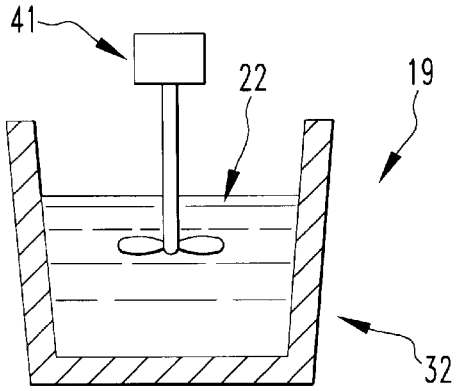
FIG. 10 is a schematic representation showing a device for stirring melted material.
Figure 11:
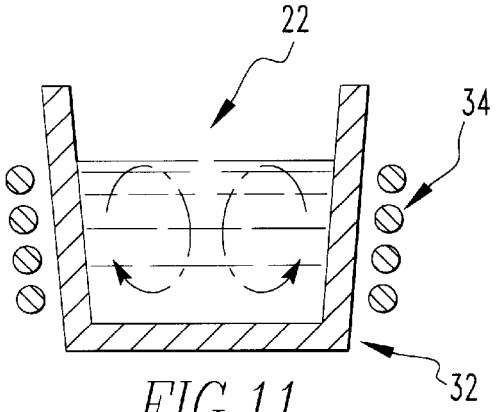
FIG. 11 is a schematic representation showing material being inductively stirred.

In a preferred embodiment, the pouring device 24 is comprised of a crucible 32 within which the fluidically based material 22 is contained and there is heating means, such as an induction coil 34, surrounding the crucible 32 within the vacuum chamber 16. The heating means could also comprise a resistive heating coil. Preferably, a catch tray 36 is disposed within the vacuum chamber 16 beneath the port 30 of the shot sleeve 26 for containing any fluidically based material 22 that may have spilled during pouring. Preferably, as shown in FIG. 10, the providing device 19 comprises means 41 for stirring the material 22. It should be appreciated, as shown in FIG. 11, that the material can also be induction stirred with the induction coil 34.

Figure 2:
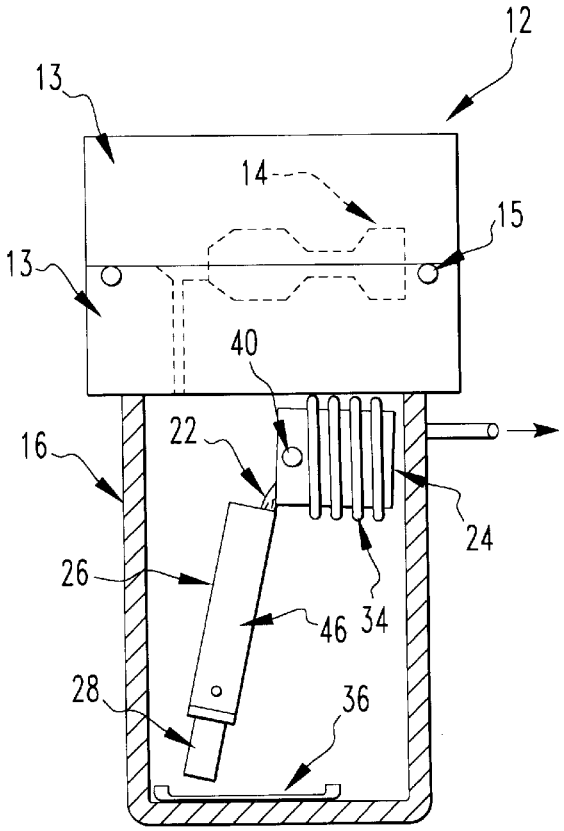
FIG. 2 is a schematic representation showing a vertical embodiment of the die casting system.
Figure 3:
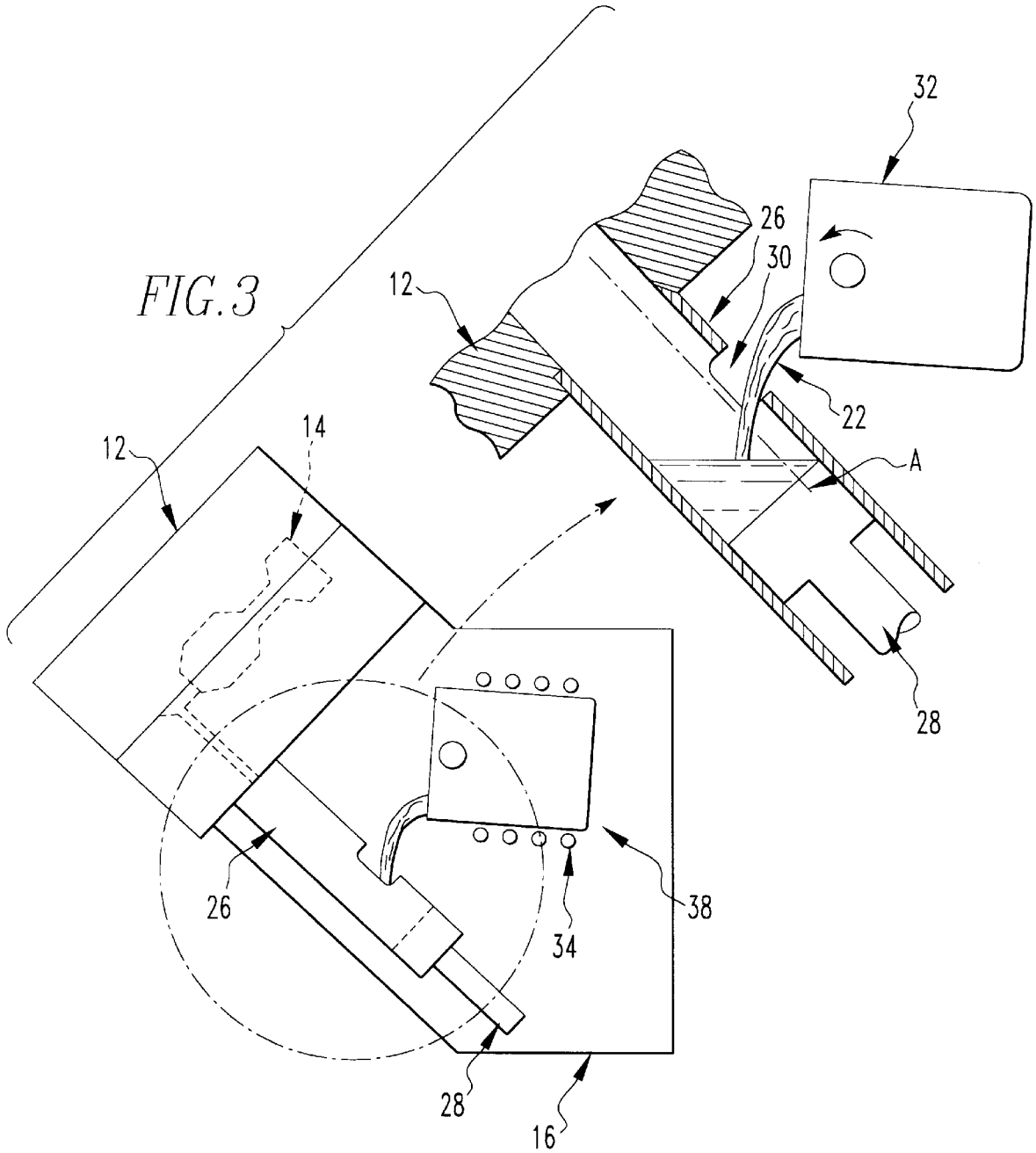
FIG. 3 is a schematic representation showing an angular embodiment of the die casting system.

In one embodiment, and as shown in FIGS. 1–3, the pouring device 24 is comprised of a tilt pour crucible system 38. The tilt pour crucible system 38 comprises a crucible 32 and a pivot element 40 about which the crucible can tilt. The tilt pour crucible system 38 also includes a mechanism (not shown), such as a handle extending from the chamber 16 for tilting the crucible 32 about the pivot element 40 such that the melted material 22 pours into the injection device 20.

It should be appreciated that the die cavity 14 and vacuum chamber 16 can be disposed in relationship to each other in a variety of ways. In a first embodiment, and as shown in FIG. 1, the vacuum chamber 16 and die 12 are disposed in a horizontal relationship. In another embodiment, and as shown in FIG. 2, the die cavity 14 and the vacuum chamber 16 are disposed in a vertical relationship with the die cavity 14 above the vacuum chamber 16. In this embodiment, the shot sleeve 20 and ram 28 can be part of a pivot injection system 46 such that when the shot sleeve 26 and ram 28 are positioned in a first orientation, the fluidically based material 22 can be poured into the shot sleeve and when the shot sleeve 26 and ram 28 are positioned in a second orientation (not shown) the fluidically based material within the shot sleeve 26 can be forced into the die cavity 14 with the ram 28.

Figure 4:
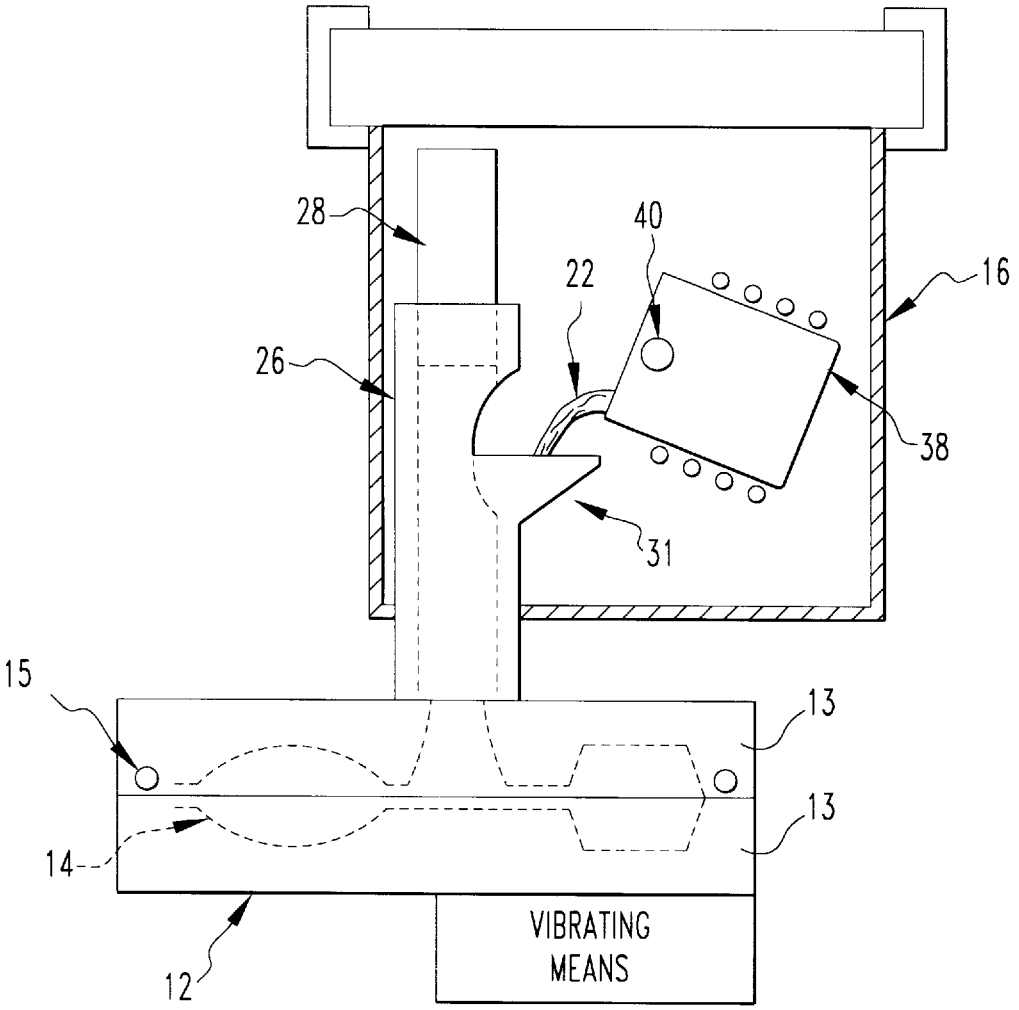
FIG. 4 is a schematic representation showing a top fill embodiment of the die casting system.

In another embodiment, as shown in FIG. 4, the die 12 is disposed below the vacuum chamber 16 such that when the fluidically based material is poured into the shot sleeve 26, it flows towards the die cavity 14 under the influence of gravity. The ram 28 then forces the fluidically based material 22 into the die cavity 14. Preferably, the port 30 has a lip 31 for collecting the fluidically based material 22 as it is poured.

In yet another embodiment, and as shown in FIG. 3, the die 12 is disposed above and in an angular relationship with the vacuum chamber 16. It should be noted that the fluidically based material 22 cannot be filled above the line represented as A in FIG. 3, otherwise it will spill out of the port 30 of the shot sleeve 26.

It should also be appreciated that the pouring device 24 can assume a variety of forms. As described previously, one embodiment of the pouring device 24 is a tilt pour crucible system 38 which pours the fluidically based material 22 into the injection device 20 by tilting a crucible 32 about a pivot element 40.

Preferably, the induction coil 34 surrounds the crucible 32 and can be designed to tilt with the crucible 32. This novel feature allows the induction coils 34 to be disposed as close as possible to the crucible 32 for efficient heating.

Figure 5:
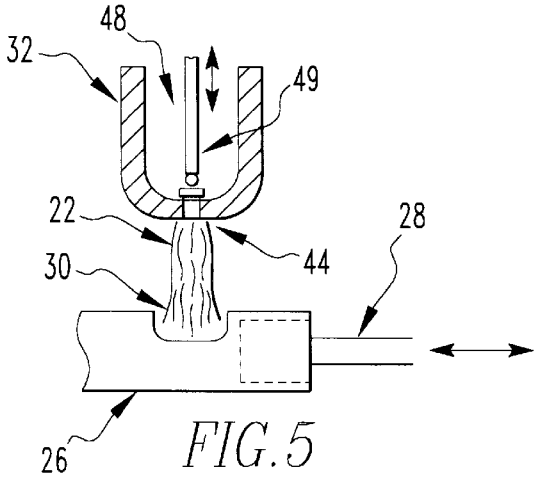
FIG. 5 is a schematic representation showing one embodiment of the pouring device.

Alternatively, as shown in FIG. 5, the pouring device 24 comprises a crucible 32 having a pour hole 44 disposed above the port 30 of the shot sleeve 26 and a lift plunger mechanism 48 for selectively opening the pour hole 44 such that when the pour hole 44 is opened, the fluidically based material 22 within the crucible 32, pours into the port 30 of the shot sleeve 26. Preferably, the lift plunger mechanism 48 comprises a plunger member 49 made of ceramic.

Figure 6:
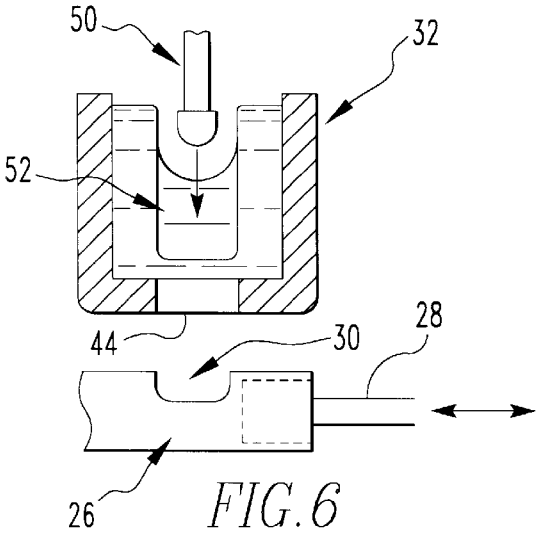
FIG. 6 is a schematic representation showing another embodiment of the pouring device.

In another embodiment, and as shown in FIG. 6, when the fluidically based material 22 is a molten metal, such as titanium, having such a high melting point or reactive nature that it needs to be self-contained, the pouring device 24 comprises a crucible 32 having a pour hole 44 and an arc melting system 50 which creates a channel 52 of molten metal within a solidified body of the metal. In this manner, the molten metal is isolated such that the interior of the vacuum chamber 16 is not excessively heated.

Figure 7:
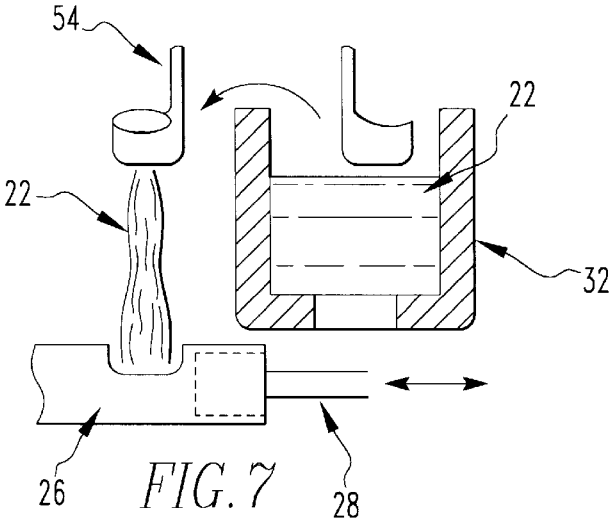
FIG. 7 is a schematic representation showing another embodiment of the pouring device.

In yet another embodiment, and as shown in FIG. 7, the pouring device 24 is comprised of a ladle mechanism 54 for collecting the fluidically based material 22 from the crucible 32 and pouring it into the port 30 of the shot sleeve 26.

Figure 8:
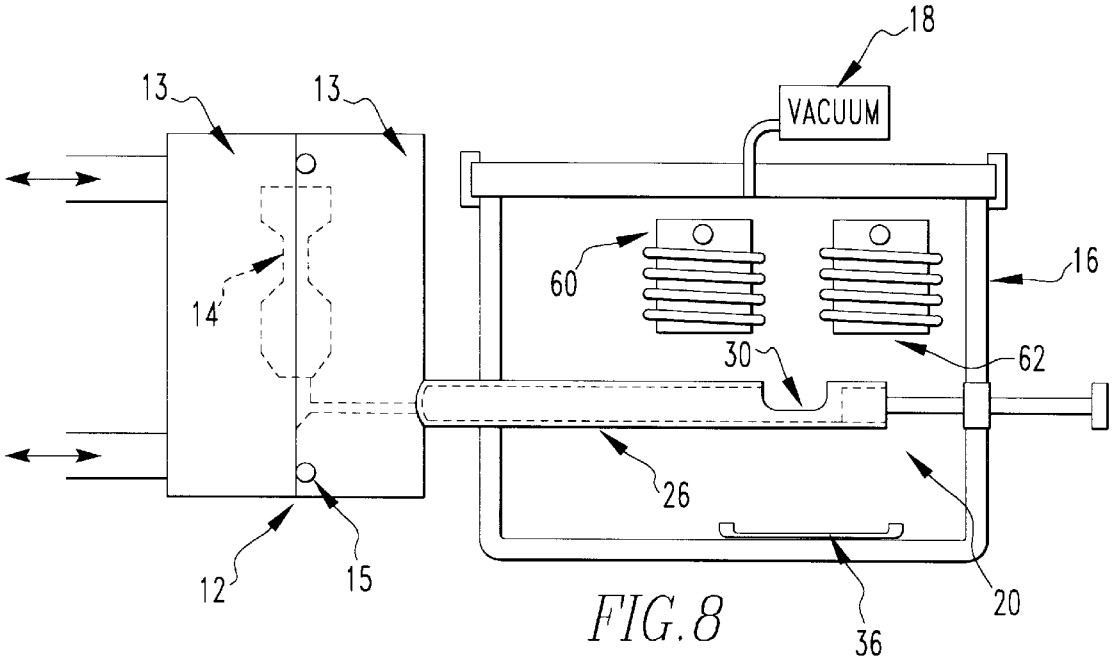
FIG. 8 is a schematic representation showing a die casting machine having two pouring devices for providing melted material and reinforcement.

As shown in FIG. 8, the pouring device 24 can comprise means 60 for pouring a first material into the injection device 20 and means 62 for pouring a second material into the injection device 20. For instance, the first material can be reinforcement material mixed with a binder, while the second material can be molten metal. In the operation of this embodiment, the reinforcement material mixed with binder is poured into the port 30 of the shot sleeve 26 in a first step, then the ram 28 is activated to force the reinforcement mixed with binder into the die cavity 14. With the ram 28 still in the extended position to fluidically seal the vacuum chamber 16 from the die cavity 14, the binder is removed, such as by heating through the side of the die 12, leaving the reinforcement having interstices disposed about within the die cavity 14. The ram 28 is then retracted and molten metal is poured into the port 30. Then, the molten metal is forced into the die cavity 14 about the interstices formed by the reinforcement to form a composite part. See U.S. Pat. No. 5,183,096, incorporated by reference.

Alternatively, reinforcement material can be placed and/or formed in the die cavity 14 without the aid of the system 10 for die casting. For instance, a preform of reinforcement can be manually placed in the die cavity 14 prior to the introduction of the fluidically based material 22. Also powdered reinforcement can be poured into the die cavity 14 from above and there can be vibrating means 29 attached to the die 12 to pack the powder, as shown in FIG. 4.

Figure 13:
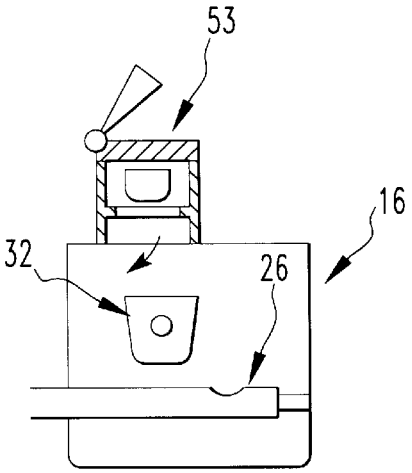
FIG. 13 is a schematic representation showing an isolation interlock device in communication with the vacuum chamber.
Figure 12:
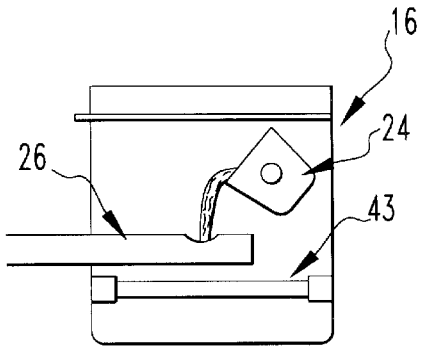
FIG. 12 is a schematic representation showing an optical overflow detector in the vacuum chamber.

As shown in FIG. 12, a detector, such as an optical detector 43, can be used to detect when the shot sleeve 26 is full or overflowing. As shown in FIG. 13, an isolation interlock device 53 can be provided for feeding the crucible 32 metal from outside the vacuum chamber 16.

The present invention is also a method of die casting. The method comprises the step of providing fluidically based material into an injection device 20 with a device 19 which is isolated from the injection device 20 within the vacuum chamber 16. Then, there is the step of forcing the fluidically based material 22 into the die cavity 14 with the injection device 20. There is the step of evacuating the die cavity and during the evacuating step, the die cavity 14 is evacuated from the vacuum chamber 16 through the injection device 20. Preferably, the providing step includes the step of pouring the fluidically based material 22 into the injection device.

In order to maintain a continuous vacuum within the vacuum chamber 16, after the forcing step, there can be the steps of fluidically isolating the vacuum chamber 16 from the die cavity 14 with the injection device 20. For instance, this can be done by maintaining the ram 28 in an extended position. Then, there are the steps of removing the cast material from the die cavity 14, fluidically sealing the die cavity and fluidically connecting the die cavity 14 to the vacuum chamber 16 by retracting the injection device 20. In this manner, a high vacuum or inert gas can continually exist in the vacuum chamber 16 and about the fluidically based material during and between casting runs. Preferably, before the pouring step, there is the step of melting the material within the vacuum chamber 16.

It should be noted that when using materials 22 such as magnesium which evaporate in a vacuum, the vacuum chamber can be backfilled with a low pressure inert gas while the die cavity 14 is evacuated. The ram 28 can be used to fluidically isolate the die cavity 14 from the vacuum chamber 16. Just before casting, the ram 28 can be pulled back to allow the metal 22 to be poured into the shot sleeve 26 for casting. This process minimizes the evaporation of the magnesium.

In the operation of the die casting system, a preform of SiC reinforcement material is placed within the die cavity 14 formed from the mating die halves 13 which are sealed together with a heat resistant o-ring seal 15. Aluminum is then placed within a graphite crucible 32 of the tilt pour crucible system 38. After the top 17 of the vacuum chamber 16 is sealed, the vacuum chamber 16 is evacuated through vacuum port 19 which is fluidically connected to the vacuum device 18. During evacuation, the ram 28 of the injection device 20 is retracted so that the die cavity and preform are evacuated through the shot sleeve, via the port 30. Once the vacuum chamber 16 and die cavity 14 are sufficiently evacuated, the crucible 32 is then titled about pivot element 40 to pour the molten aluminum into the shot sleeve. The ram 28 is then activated to force the melted aluminum through the shot sleeve 26 into the evacuated die cavity 14 into the preform. The molten aluminum subsequently solidifies in and about the preform to form a composite part. During cooling, the ram 28 is maintained in the extended position to fluidically isolate the die cavity 14 from the vacuum chamber 16. In this manner, the fluidic seal between the mating die halves 13 can be broken to remove the cast part, while the vacuum chamber 16 is maintained in an evacuated state. This allows the molten aluminum within the crucible to be continually maintained in a high vacuum or in a controlled gas environment during and between casting runs.

After the cast part is removed, the mating die halves 13 are sealed together and the ram 28 is retracted to fluidically connect the die cavity 14 to the vacuum chamber 16. This action evacuates the die cavity 14 for the next casting run.

Reinforcement such as silicon carbide, alumina, or carbon in different forms such as grit, platelet, or chopped fiber may be mixed into the liquid metal held in the crucible within the vacuum/gas chamber.

The composite mixture may then be poured into the shot sleeve and forced into the mold with the ram.

This method makes it possible to maintain high vacuums or a protective gas covering over the liquid metal containing the reinforcement. Not only can aluminum alloys be cast, but also magnesium and lithium, which would ignite if exposed to oxygen.

This method also makes it possible to inject higher volume fractions of reinforcement than other methods. For example, (filler) reinforcement alone may be placed in the shot sleeve as taught by Joseph T. Roddy, U.S. Pat. No. 4,340,109, and then liquid aluminum can be placed in the same shot sleeve and then a ram can be used to force both into a mold cavity at the same time. This process causes extreme forces between the ram and cylinder wall as loose material is forced forward. Within a short number of injections, especially with the sand filler described, the ram would either get stuck or start to leak due to excessive wear between the ram and cylinder wall. Also, sand and other types of fillers tend to pack when forced is applied. They do not readily mix or flow. Only with very small amounts of filler compared to liquid metal would the (filler) reinforcement mix into the liquid metal and flow into the mold. There is also not enough mixing action to uniformly disperse the (filler) reinforcement in the liquid metal. As a result, the reinforcement would be unevenly distributed within the part created. For all these reasons, the system described by Roddy is not a practical method for producing (filled) reinforced parts of any structural or commercial value. It should be remembered that Roddy's purpose was to reduce the amount of metal required for motor housings, so that there was little concern for a uniformly disbursed reinforcement.

To inject with loadings over 35%, the reinforcement must first be uniformly disbursed within the liquid metal. This may require a combination of mechanical forces as well as wetting agents. Once each individual piece of reinforcement is surrounded by liquid metal, the reinforcement can flow past other pieces of reinforcement. By controlling the particle sizes mixed into liquid metal, it is possible to create systems which flow easily with solid volume fraction loadings as high as 75%. Volume fractions up to 55% can be caused to flow with one particle size, volume fractions over 55% require more than one particle size. Also, by using more than one particle size in volume fractions under 55%, the viscosity is lower when compared to the same loading with one particle size.

A wide variety of particle sizes may be used from submicron to over 500 micron in diameter. With die casting particle sizes between 1 and 300, microns are preferred since they can flow through the injection cylinder and into the mold cavity easily. Larger particles tend to clog passageways while smaller particles are difficult to mix in uniformly. Smaller particles also provide a large amount of surface area in comparison to their volume and as such do not provide the same physical benefits in the composite as larger particles of the same material.

Other systems using funnels may be used to direct the composite material into the shot sleeve. These however, only cause other problems such as material contamination, clogging, and extra expense for cleaning and replacement.

By premixing the reinforcement into the liquid metal and pouring it directly in the shot sleeve within a vacuum/gas chamber, the optimum production method is established. The vacuum chamber evacuates the mold cavity through the shot sleeve (cylinder), while at the same time removing trapped gasses from the melt. By pouring inside, no gas is trapped and a high quality, uniformly reinforced casting is created. Because the reinforcement is surrounded with liquid metal, much higher loadings of reinforcement can be forced into the mold cavity without damaging the shot sleeve or ram. Because of the rapid speed which this system can be run, it is ideal for manufacturing large volumes of a wide range of different part sizes and complexities from many different composite systems including metal/metal, metal/ceramic, and metal/carbon composites.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A system for die casting comprising:

a die having a die cavity;

a vacuum chamber;

a device for creating a vacuum in the vacuum chamber, said vacuum creating device in fluidic communication with the vacuum chamber;

an injection device for introducing a fluidically based material into the die cavity from the vacuum chamber, said injection device in fluidic communication with said die cavity and at least partially disposed within said vacuum chamber;

a device for providing the fluidically based material into the injection device, said providing device separated from said injection device; and a catch tray disposed below the injection device to receive any fluidically based material that overflows the injection device when the injection device is being filled with the fluidically based material from the providing device so the injection device does not clog from the overflow of fluidically based material.

2. A system as described in claim 1 wherein said providing device is disposed within said vacuum chamber.

3. A system as described in claim 2 wherein the providing device comprises a device for pouring the fluidically based material into the injection device.

4. A system as described in claim 3 wherein the device for creating a vacuum is fluidically connected to the vacuum chamber such that the die cavity can be evacuated from the vacuum chamber through the injection device.

5. A system as described in claim 3 including means for evacuating the die cavity, said evacuating means in fluidic communication with the die cavity and separate from the vacuum creating device.

6. A system as described in claim 3 wherein the injection device is comprised of a shot sleeve, said shot sleeve having a port through which the fluidically based material is poured into the shot sleeve from the pouring device, said shot sleeve fluidically connecting the die cavity to the vacuum chamber.

7. A system as described in claim 6 wherein the injection device comprises a ram for forcing melted material through the shot sleeve into the die cavity, said ram disposed within said shot sleeve.

8. A system as described in claim 6 wherein the injection device comprises means for providing gas to the vacuum chamber.

9. A system as described in claim 3 wherein the providing device comprises means for stirring the material.

10. A system as described in claim 7 wherein the die is disposed above the vacuum chamber and the shot sleeve and ram are elements of a pivot injection system such that when the shot sleeve and ram are disposed in a first orientation, the fluidically based material can be poured into the shot sleeve and when the shot sleeve and ram are disposed in a second orientation, the fluidically based material within the shot sleeve can be forced into the die cavity with the ram.

11. A system as described in claim 6 wherein the die is disposed below the vacuum chamber such that when the fluidically based material is poured into the port of the shot sleeve, it flows towards the die cavity under the influence of gravity.

12. A system as described in claim 6 wherein the pouring device is comprised of a ladle mechanism for collecting the fluidically based material from the crucible and pouring it into the port of the shot sleeve.

13. A system as described in claim 1 wherein the pouring device comprises means for providing a first material into the injection device and means for providing a second material into the injection device, both of said providing means isolated from said injection device, and disposed within the vacuum chamber.

14. A system as described in claim 6 including a detector for detecting when the shot sleeve is full.

15. A system as described in claim 2 including an isolation interlock device for feeding the providing device with metal, said isolation interlock device disposed outside said vacuum chamber.

16. A method of die casting comprising the steps of:

providing fluidically based material into an injection device with a device which is separated from the injection device within a vacuum chamber;

catching any overflow of the fluidically based material in a catch tray disposed below the injection device; and forcing the fluidically based material into the die cavity with said injection device.

17. A method as described in claim 16 wherein the providing step includes the step of pouring the fluidically based material into the injection device within the vacuum chamber.

18. A method as described in claim 17 wherein before the providing step, there is the step of evacuating the vacuum chamber.

19. A method as described in claim 18 wherein before the forcing step, there is the step of evacuating the die cavity.

20. A method as described in claim 19 wherein the step of evacuating the vacuum chamber also evacuates the die cavity.

* * * * *